US008573764B2

(12) United States Patent
Saito et al.

(10) Patent No.: US 8,573,764 B2
(45) Date of Patent: Nov. 5, 2013

(54) DRYING APPARATUS AND PRINTING APPARATUS

(75) Inventors: Riichi Saito, Fujisawa (JP); Noribumi Koitabashi, Yokohama (JP); Tsuyoshi Kanke, Yokohama (JP); Kentarou Muro, Tokyo (JP); Akio Okubo, Tokyo (JP); Yoshiaki Suzuki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 232 days.

(21) Appl. No.: 12/962,032

(22) Filed: Dec. 7, 2010

(65) Prior Publication Data

US 2011/0164101 A1 Jul. 7, 2011

(30) Foreign Application Priority Data

Jan. 7, 2010 (JP) ..... 2010-002102

(51) Int. Cl.
*B41J 2/01* (2006.01)

(52) U.S. Cl.
USPC ..... 347/102; 347/101; 347/104

(58) Field of Classification Search
USPC ..... 347/101, 102, 104
See application file for complete search history.

(56) References Cited

U.S. PATENT DOCUMENTS

| | | | | |
|---|---|---|---|---|
| 3,800,432 | A * | 4/1974 | Miyata et al. | 34/620 |
| 4,973,824 | A * | 11/1990 | Ohashi et al. | 219/216 |
| 6,336,722 | B1 * | 1/2002 | Wotton et al. | 347/102 |
| 6,582,072 | B1 * | 6/2003 | Wotton et al. | 347/104 |
| 7,077,584 | B2 * | 7/2006 | Yoshida | 396/571 |

FOREIGN PATENT DOCUMENTS

JP 2657571 B2 9/1997

* cited by examiner

*Primary Examiner* — Laura Martin
*Assistant Examiner* — Jeremy Bishop
(74) *Attorney, Agent, or Firm* — Canon U.S.A., Inc. IP Division

(57) ABSTRACT

A drying apparatus includes: a rotatable belt which has an outer surface and an inner surface, the outer surface contacts a sheet; a blowing mechanism which blows hot air on the sheet at a side of the outer surface; and a heating unit which includes a heating element and a contact surface which is disposed in contact with the inner surface. A plurality of rollers are arranged in a direction in which the sheet travels. The rollers are pressed against the outer surface of the belt with the travelling sheet being held between the rollers and the outer surface of the belt.

19 Claims, 9 Drawing Sheets

DRYING APPARATUS AND PRINTING APPARATUS

BACKGROUND OF THE INVENTION

1. Field of the Invention

The present invention relates to a drying apparatus which dries sheets with high moisture content after printing, and a printing apparatus.

2. Description of the Related Art

In a printing apparatus, a sheet should be dried after becoming wet in an image formation process. The sheet may be dried naturally or in a forced manner for short time drying. Japanese Patent No. 2657571 discloses an apparatus in which a photosensitive sheet of a silver halide photosensitive material is subject to forced drying after becoming wet in a developing process. The disclosed apparatus includes an endless belt provided along a sheet travelling direction. The endless belt rotates in contact with a back surface of the sheet. Hot air is blown on the endless belt through an ejection port to increase a temperature of the belt. This means that the endless belt is heated by the hot air. The heated belt contacts the sheet which is being conveyed and accelerates drying.

A high-speed printing apparatus prints on several tens or hundreds of sheets per minute on a DIN A4-sized sheet basis. The sheets are conveyed at average speed of several millimeters to several centimeters per second. A drying apparatus should be capable of drying each sheet in several seconds and continuing the drying operation for a long time. However, it is difficult to use the apparatus disclosed in Japanese Patent No. 2657571 for high speed continuous printing for the following reasons.

In high-speed continuous printing, the temperature of the endless belt decreases gradually as drying time elapses as illustrated in a curve B of a temperature transition graph of FIG. 11. The decrease in the temperature of the endless belt is caused by the release of latent heat when the moisture evaporates from the sheet. The reason of the continuous decrease in temperature of the endless belt is as follows. During the continuous printing, the hot air blowing on the endless belt is blocked by the sheets and thus heating of the endless belt becomes insufficient. As a result, the temperature of the endless belt decreases continuously as the printing is continued for a long time, and when the temperature is below the lower limit permissive temperature for obtaining necessary drying performance (T-min), drying performance which is necessary cannot be exhibited.

If the temperature of the hot air which is blown on the endless belt is increased to achieve an increased initial temperature of the endless belt, the time until the curve B reaches the T-min may be prolonged. However, due to the upper limit permissive temperature of resistance to heat of the sheet (T-max), the temperature of the hot air cannot be increased excessively. The sheet used for printing is constituted by, for example, a receptive layer and a base film. The T-max of the sheet is, for example, 90 degrees C. and it is undesirable to heat the sheet to a temperature above the T-max.

SUMMARY OF THE INVENTION

The present invention has been made in view of the aforementioned circumstances. The present invention provides a drying apparatus which dries sheets in high-speed continuous printing.

An apparatus for drying a sheet according to the present invention includes: a rotatable belt which has an outer surface and an inner surface, a part of the outer surface being in contact with the sheet; a plurality of rollers arranged in a direction in which the sheet travels, the rollers including a first roller and a second roller which are adjacent to each other, the rollers being pressed against the outer surface with the travelling sheet being held between the rollers and the outer surface; a blowing mechanism which blows hot air on the sheet from between the first roller and the second roller; and a heating unit which includes a heating element and a contact surface which is disposed in contact with the inner surface.

According to the present invention, a drying apparatus suitable for a printing apparatus that is capable of high-speed continuous printing is provided. Since sheets can be dried reliably in high speed continuous printing, insufficient or uneven drying can be avoided.

Further features of the present invention will become apparent from the following description of exemplary embodiments with reference to the attached drawings.

DESCRIPTION OF THE EMBODIMENTS

Hereinafter, an embodiment of an inkjet printing apparatus will be described. A printing apparatus according to the present embodiment is a high speed line printer capable of high speed continuous printing using a rolled-up continuous sheet. For example, the printing apparatus is suitable for printing a large number of sheets in a printing laboratory. The printing apparatus according to the present invention can be applied to an apparatus for silver halide photographic printing in which images are developed with liquids as well as the inkjet printing apparatus. The printing apparatus according to the present invention can also be applied to apparatuses with a printing function, such as apparatuses for manufacturing various devices.

First Embodiment

Figure 1:
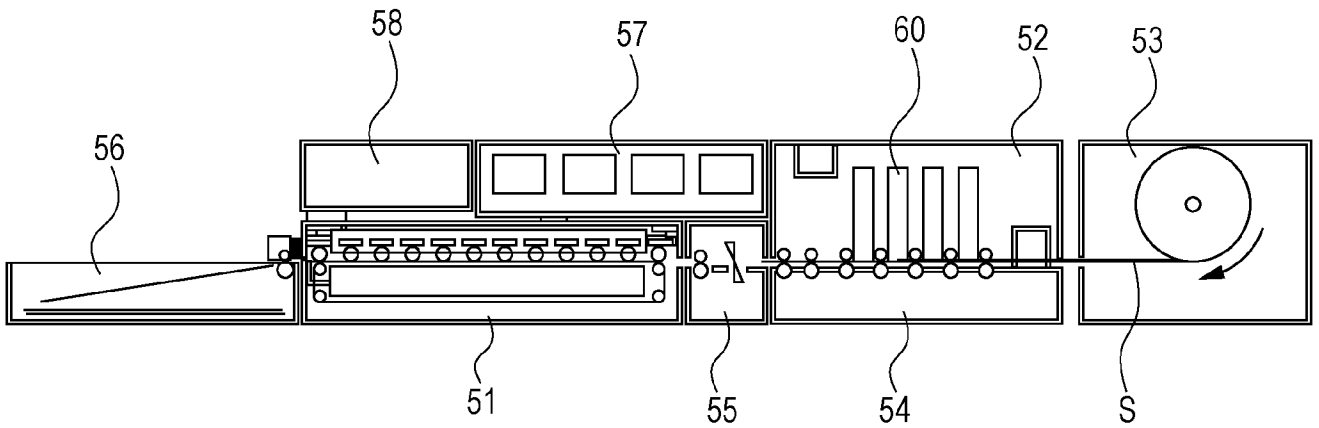
FIG. 1 is an overall structural view of a printing apparatus.
Figure 2:
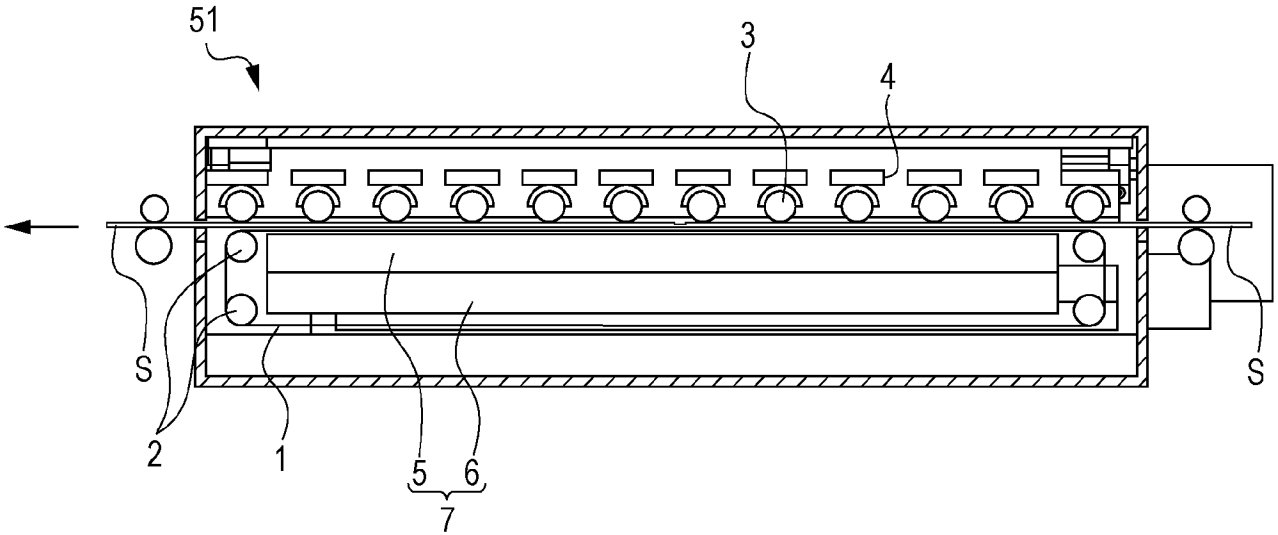
FIG. 2 is a sectional view of a structure of a drying apparatus.

FIG. 1 is an overall structural view of an inkjet printing apparatus according to the present embodiment. The printing apparatus includes therein a sheet feeding unit 53, a printing unit 52, a cutting unit 55, a drying unit 51, a sheet discharge unit 56, an ink tank unit 57 and a control unit 58. A sheet S is conveyed, by a conveyance mechanism consisting of pairs of rollers and a belt, along a sheet conveyance path which is directed from the right to the left as illustrated in FIG. 2 and is processed in each of the units.

The sheet feeding unit 53 accommodates a rolled-up continuous sheet and supplies the same. The sheet feeding unit 53 can accommodate one or more rolls, and the sheet S is drawn and supplied from any desired one of the rolls.

The printing unit 52 forms an image on the sheet by applying ink from print heads 60 on the sheet which is being conveyed. The printing unit 52 also includes a plurality of conveying rollers which convey the sheet. Each of the print heads 60 is a linear printing head constituted by an array of inkjet nozzles disposed over the maximum width of a sheet expected to be used. The print heads 60 are arranged in parallel along the sheet travelling (i.e., conveyance) direction. In the present embodiment, four print heads corresponding to cyan (C), magenta (M), yellow (Y) and black (K) are provided. The numbers of the colors and the print heads are not limited to four. The inkjet printing system may be, for example, a thermal inkjet printing system, a piezoelectric inkjet printing system, an electrostatic inkjet printing system and a MEMS inkjet printing system. The colored ink is separately supplied to each print head 60 via an ink tube from the ink tank unit 57. The cutting unit 55 is provided with a cutter for cutting the continuous sheet into predetermined unit lengths after the sheet is subject to the printing process.

The drying unit 51 heats the sheet after the sheet is subject to the printing process in the printing unit 52 and dries the applied ink in a short time. The drying unit 51 includes a belt and rollers for conveying and sending the sheet. The drying unit 51 will be described in mover detail later.

The control unit 58 includes a controller provided with a CPU, memory and various I/O interfaces. The control unit 58 further includes a user interface which is constituted by an input section and a display device. A user can input and output various types of information through the user interface. The operation of the printing apparatus is controlled in accordance with instructions from the controller of the control unit 58 or external devices, such as a host computer, which is connected to the controller via the I/O interface.

Figure 3:
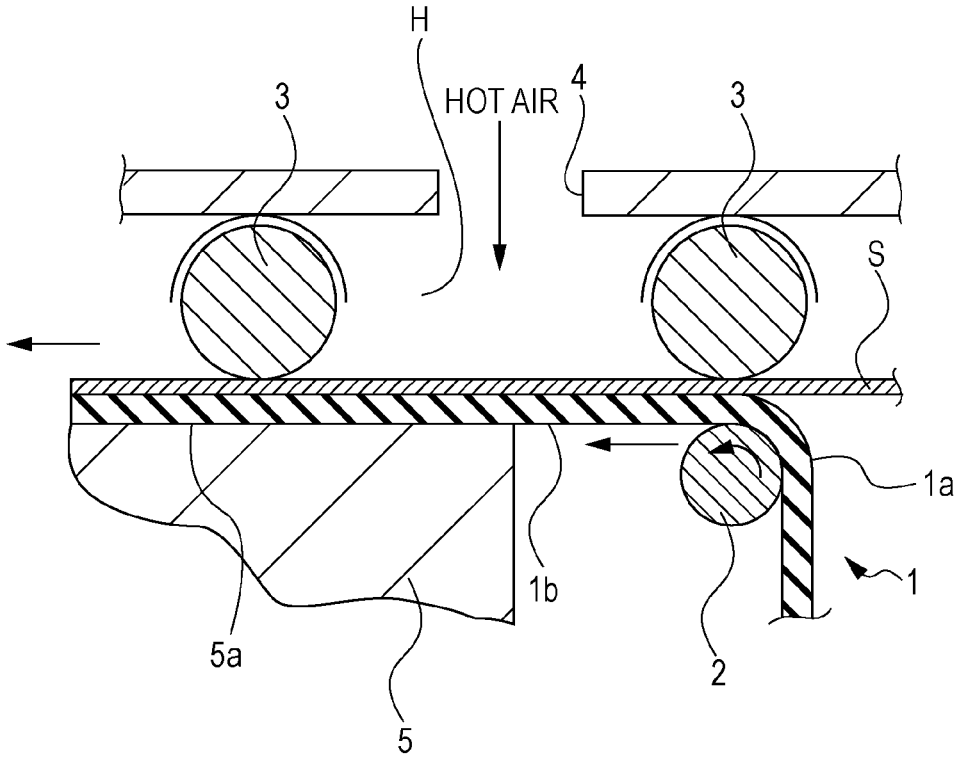
FIG. 3 is a partially enlarged view of the drying apparatus.
Figure 4:
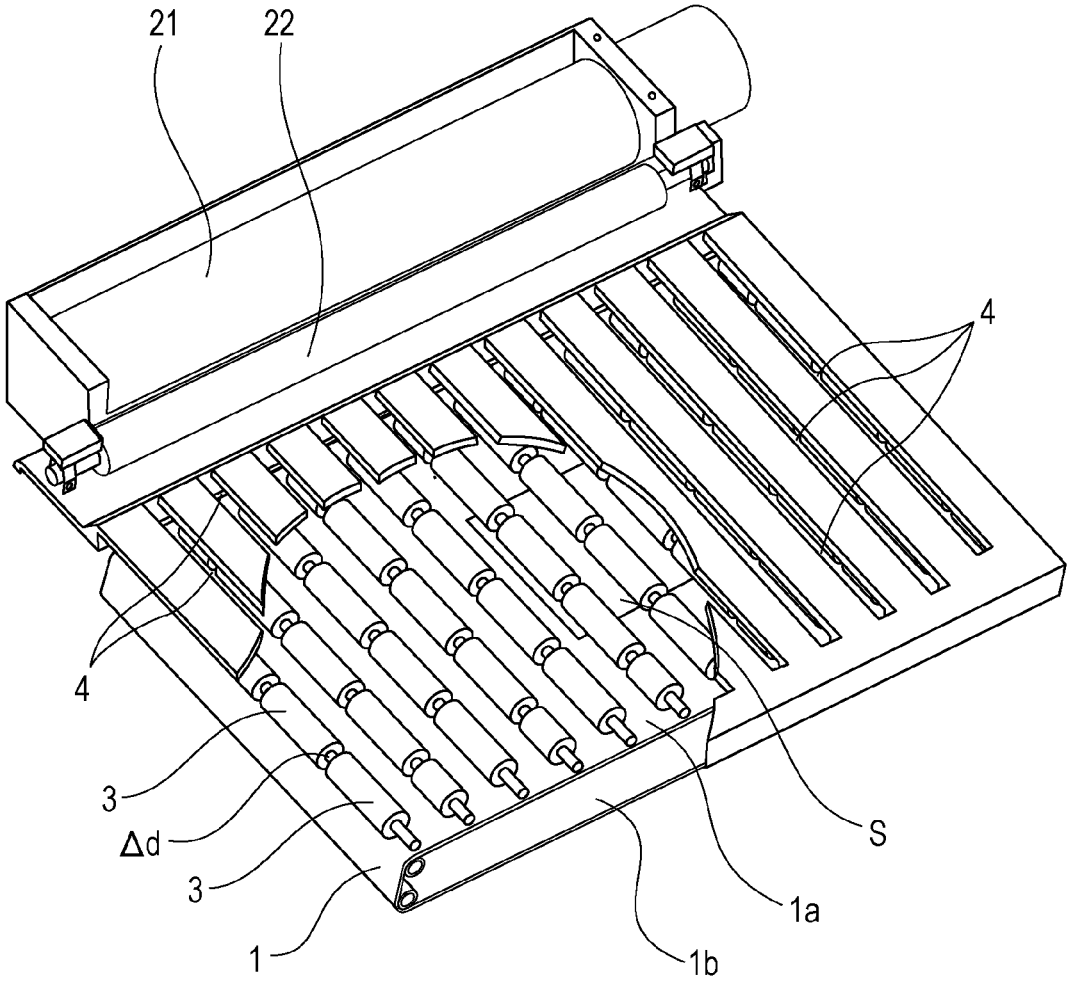
FIG. 4 is a perspective view of the structure of the drying apparatus.

FIG. 2 is a sectional view of a structure of the drying unit 51. FIG. 3 is a partially enlarged view and FIG. 4 is a perspective view of FIG. 2. In the drying unit 51, a rotatable belt 1 formed as an endless belt, a plurality of rollers (i.e., pinch rollers) 3 and a heating unit 7 are accommodated in a chamber.

The belt 1 has an outer surface 1*a* and an inner surface 1*b* on opposite sides thereof. A part of the outer surface 1*a* of the belt 1 contacts the sheet S or the rollers 3. Four rollers 2 are provided in a space surrounded by the inner surface 1*b* of the belt 1 to support and rotate the belt 1 in an extended state. At least one of the rollers 2 is provided with driving force to rotate the belt 1. The heating unit 7 is disposed in the space surrounded by the inner surface 1*b* of the belt 1. The heating unit 7 includes a contact portion 5 and a heating element 6. The contact portion 5 has a contact surface 5*a* which is in contact with the inner surface 1*b*. The contact portion 5 and the heating element 6 may be provided integrally or may be provided separately. The heating element 6 may be a heater, such as a panel heater, a ceramic heater and an infrared lamp. A surface temperature of the contact surface 5*a* is increased to a predetermined temperature (e.g., 75 degrees C.) by the heating element 6. Since the belt 1 is in contact with and is heated by the contact surface 5*a* while being rotated, the temperature of the entire belt 1 can be increased. Preferably, both the belt 1 and the contact portion 5 are highly thermally conductive. Also preferably, heat is transferred from the contact portion 5 to the belt 1 with little heat loss. Thus, the belt 1 is preferably formed of, for example, heat stable fiber, such as Kevlar fiber and aramid fiber, and is coated with rubber, such as highly thermally conductive carbon-containing silicon. The contact surface 5*a* (i.e., the contact portion 5) is preferably formed of a metallic material, such as highly thermally conductive aluminum, copper and stainless steel, and a carbon graphite resin material.

The rollers (i.e., pinch rollers) 3 are disposed above the belt 1 in parallel along the sheet travelling direction. The rollers 3 have no driving force and follow the rotation of the belt 1. Each of the rollers 3 receives predetermined urging force and is pressed against the outer surface 1*a* of the belt 1. The rollers 3 are provided for the following two reasons. First, the sheet S is held firmly between the rollers 3 and the belt 1 so that the sheet is reliably conveyed in the drying unit 51. Second, since the rollers 3 press the outer surface 1*a* of the belt 1, the sheet S which is being conveyed is brought into close contact with the outer surface 1*a* of the belt 1. Further, the inner surface 1*b* of the belt 1 and the contact surface 5*a* of the heating unit 7 are brought into close contact with each other. With the close contact, the heat of the heating unit 7 will be transferred to the belt 1 with high efficiency and the heat of the belt 1 is transferred to the sheet S with high efficiency. In order to enhance these effects, three or more rollers 3 are preferably provided. Twelve rollers are provided in the present embodiment.

As illustrated in FIG. 4, each of the rollers 3 is divided into a plurality of small roller sections at equal intervals (i.e., at equal pitches). Note that some of the small roller sections at both ends of the rollers 3 are shorter than other inside ones. That is, in each of the rollers 3, a plurality of small roller sections are arranged in series on a rotation axis. In each of the rollers 3, gaps Δd of predetermined dimension are formed at positions at which the roller 3 is divided into the small roller sections (i.e., spaces between adjacent small roller sections). Positions of the gaps Δd of the rollers 3 arranged adjacent to one another along the sheet travelling direction are at least partially displaced from one another along the direction of the rotational axis (i.e., the direction in which the rotation axes extend). That is, the gaps are at least partially disposed at equal pitches but displaced from one another. That is, the rollers 3 with the gaps Δd of the same arrangement are not disposed adjacent to each other but are disposed alternately or at intervals of several rollers along the sheet travelling direction. In the example of FIG. 4, the rollers 3 with the gaps Δd of the same arrangement are disposed alternately along the sheet conveyance direction. Thus, the divided small roller sections are disposed in a regular alternate arrangement, i.e., a staggered arrangement. The staggered arrangement is illustrative only and the small roller sections may be divided in other regular arrangements. Although no small roller section but the rotation axis exists in the gaps Δd in the above structure, grooves having the same width as that of the gap Δd may be formed on the surfaces of the rollers 3 such that the rollers 3 are substantially divided into small roller sections.

Ejection ports 4 are provided at positions corresponding to spaces between arbitrary two adjacent rollers 3 (i.e., a first roller and a second roller). High temperature air flows (i.e., hot air) are blown on the sheet S from between the adjacent rollers 3 and through the ejection ports 4. Each of the ejection ports 4 is a penetration hole formed in a plate member, and is formed as an elongated slit extending in a direction parallel to the direction of the rotation axis of the rollers 3 when seen from above. As a means to generate a high temperature air flow, a blower fan 21 and a rod-shaped heater 22 are provided. The blower fan 21, the heater 22 and the ejection ports 4 altogether constitute an air blowing mechanism which blows, from the side of the outer surface 1*a* of the belt 1, the hot air on the sheet S which is being conveyed.

Figure 5:
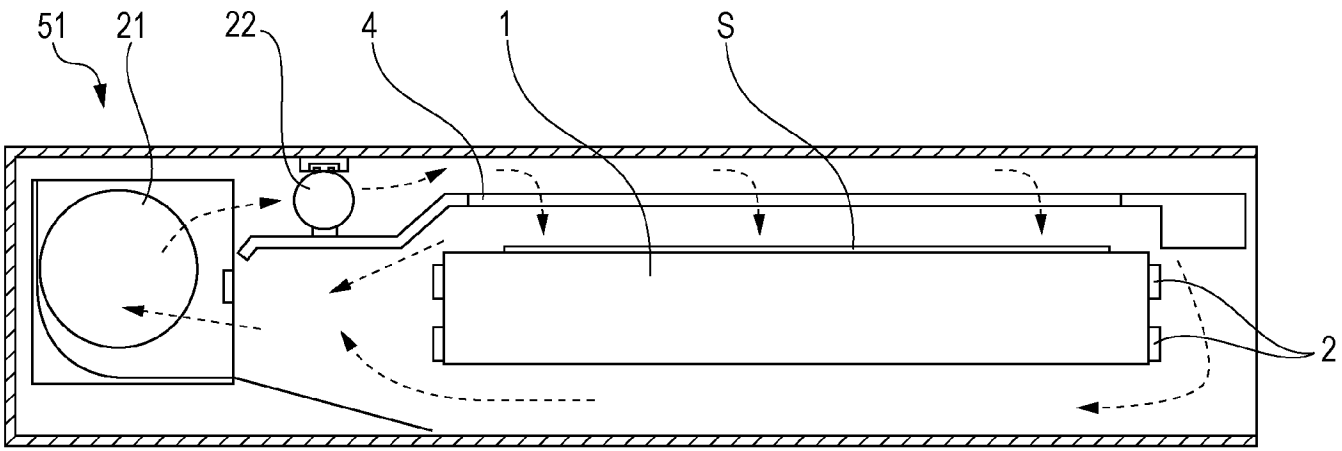
FIG. 5 illustrates air flows in a chamber of the drying apparatus.

FIG. 5 illustrates the drying unit 51 as a sectional view different from that of FIG. 2. FIG. 5 illustrates air flows in the chamber. The air flows are illustrated by dashed line arrows. The air flow generated by the blower fan 21 is sent to the heater 22 and is heated while passing through the heater 22. The hot air is blown down through the ejection ports 4 and is blown on a surface of the sheet S. The hot air moved below the belt 1 after being blown on the sheet S is absorbed by the blower fan 21 and is resent so as to circulate through a housing of the device.

The front surface of the sheet S which became wet in the printing process is heated by the hot air and the back surface of the sheet S is heated by the belt 1. In this manner, the ink is dried in an accelerated manner. Since the belt 1 is heated on its inner surface 1*b* by the heating unit 7 during operation of the apparatus, the belt 1 can keep a desired temperature during a long-time continuous printing. The desired temperature is in a range of between the lower limit permissive temperature for obtaining necessary drying performance (T-min) and the upper limit permissive temperature of resistance to heat of the sheet (T-max).

Figure 11:
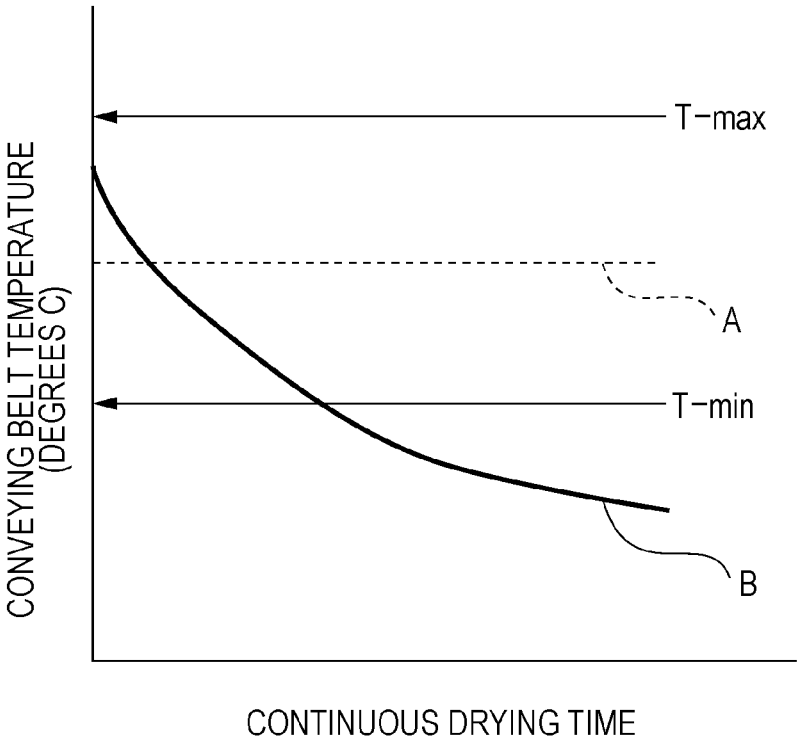
FIG. 11 is a graph illustrating a relationship between continuous drying time and temperature change in a belt.

FIG. 11 is a graph illustrating a relationship between continuous drying time and temperature change in the belt 1. A curve A represents temperature change in the belt 1 in the apparatus according to the present embodiment, which shows that a substantially constant temperature is being kept. If no heating unit 7 is provided, as illustrated by a curve B in FIG. 11, the temperature of the belt 1 decreases gradually as the drying time elapses. The decrease in the temperature of the belt 1 is caused by the release of latent heat when the moisture evaporates from the sheet S. When the temperature of the belt 1 is below the T-min, necessary drying performance cannot be exhibited.

When a wide sheet S is used, it is possible that the hot air which is blown on a printed surface and has increased in humidity may stagnate in spaces between adjacent rollers 3 (i.e., spaces H of FIG. 3), thereby decreasing the drying efficiency. This problem is solved by the gaps Δd provided between the rollers 3 as illustrated in FIG. 4. That is, a part of the hot air blown on the spaces H between adjacent rollers 3 through the ejection ports 4 is efficiently exhausted through the gaps Δd.

The rollers 3, which are the pinch rollers, press the outer surface 1*a* of the belt 1 with predetermined urging force with the sheet S being held therebetween. When being pressed in this manner, the inner surface 1*b* of the belt 1 is pressed against the contact portion 5 of the heating unit 7, whereby the heat is efficiently transferred to the belt 1 from the contact surface 5*a* of the contact portion 5. If no roller 3 exists, clearance or an air layer may be easily formed between the inner surface 1*b* of the belt 1 and the contact surface 5*a*, and between the outer surface 1*a* of the belt 1 and the sheet S, whereby heat transfer to the back surface of the sheet S may become insufficient.

In the example of FIG. 4, the rollers 3 do not press the outer surface 1*a* of the belt 1 in the areas corresponding to the gaps Δd in a strict sense. Thus, the inner surface 1*b* and the contact surface 5*a* do not contact each other. Even if the inner surface 1*b* and the contact surface 5*a* contact each other, contact pressure is small and thus the heat is transferred inefficiently. That is, it is possible that an amount of the heat transferred from the contact surface 5*a* to the belt 1 might vary in different areas of the rollers 3 which are divided in the direction of the rotation axis. As a result, the temperature of the belt 1 may become locally non-uniform.

This problem is solved by the varying arrangement of the gaps Δd in the direction of the rotation axis of the rollers 3 arranged in the sheet travelling direction as illustrated in FIG. 4. If the gaps Δd of all the rollers 3 are arranged in the same manner in the direction of the rotation axis, i.e., if the gaps Δd are disposed in series along the sheet travelling direction, low temperature areas are generated in streaks in the belt 1 corresponding to the positions of the gaps Δd. As a result, temperature distribution may become non-uniform across the belt 1. Such non-uniform temperature distribution may cause non-uniform drying in streaks and an obtained image may have unevenness in color. In order to address this problem, the gaps Δd of the rollers 3 in the present embodiment are formed in varying positions along the direction of the rotation axis as illustrated in FIG. 4. That is, in arbitrary two adjacent rollers (i.e., the first roller and the second roller) among the plurality of rollers 3, positions of the gaps Δd formed in the first roller and the gaps Δd formed in the second roller are at least partially displaced from one another along the direction of the rotational axis. With such a displaced arrangement of the gaps Δd, the belt 1 can be heated more uniformly, whereby the problem described above can be avoided. As described above, such an arrangement of the divided small roller sections of the rollers 3 solves both the problem of stagnant air in the spaces between adjacent rollers 3 and the problem of non-uniform temperature of the belt 1.

As the operating time of the apparatus is increased and the rotating time of the belt is also increased, the inner side of the belt 1 may be worn and slippage may be caused between the belt 1 and the rollers 3. Such slippage reduces the rotational speed of the belt 1 and, as a result, the sheet conveyance speed in the drying unit 51 becomes incorrect. In order to avoid this problem, it is desirable to prevent the wear of the belt 1 caused by the contact portion 5 as much as possible. Since the belt 1 is a flexible member, most of the wear occurs on the belt 1 in contact with the contact surface 5*a* of the contact portion 5. In order to reduce the wear of the belt 1, the contact frictional resistance should be lowered or the contact area should be reduced.

In order to lower the contact frictional resistance, a friction coefficient of the outer surface 1*a* of the belt 1 must be larger than those of the inner surface 1*b* and the contact surface 5*a*. For example, the friction coefficients of the inner surface 1*b* and the contact surface 5*a* (or the frictional resistance between the inner surface 1*b* and the contact surface 5*a*) preferably are 0.2 to 0.5. With such friction coefficients, the outer surface 1*a* of the belt 1 reliably holds the sheet S and the wear of the belt 1 due to contact friction between the inner surface 1*b* and the contact surface 5*a* is reduced.

Figure 6:
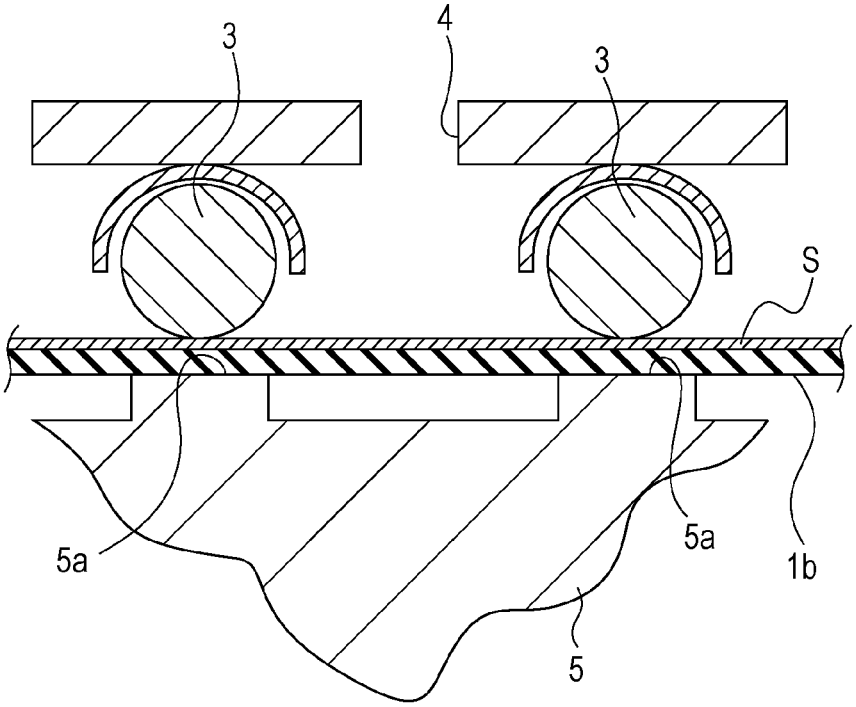
FIG. 6 is a sectional view of a structure in which contact surfaces are formed only at positions facing rollers.

In order to reduce the contact area, the area in which the contact surface 5*a* contacts the belt 1 should be reduced as much as possible. For example, as illustrated in FIG. 6, separately-formed two contact surfaces 5*a* (i.e., a first contact surface and a second contact surface) may be provided only at positions facing adjacent rollers 3 (i.e., the first roller and the second roller). Such a structure reduces the total contact area and, as a result, the wear of the belt 1 can be reduced.

Figure 7:
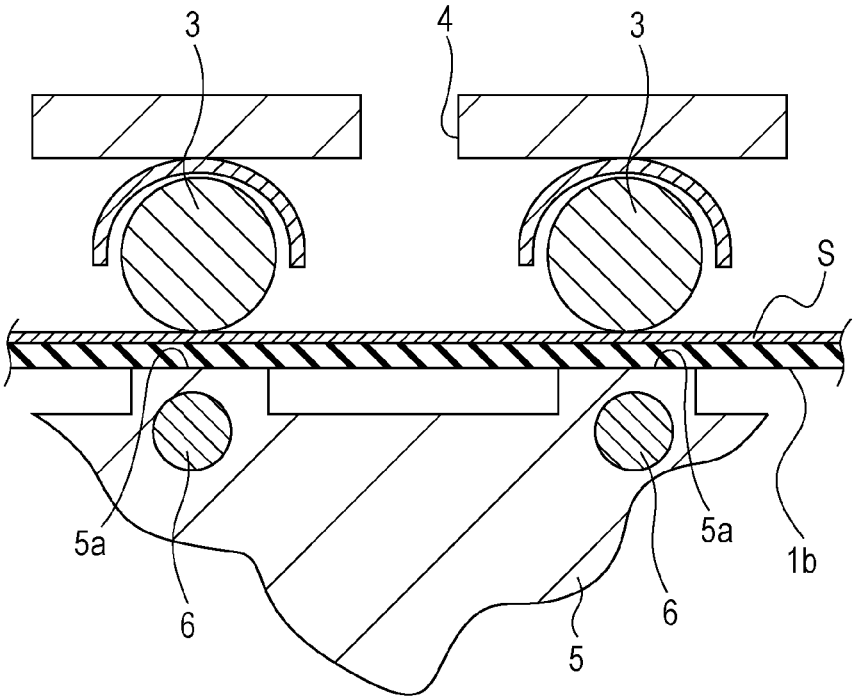
FIG. 7 is a sectional view of a structure in which heaters are formed only at positions facing rollers.

In addition, from the viewpoint of energy saving of the apparatus, power consumption in the heating element 6 of the heating unit 7 is preferably reduced. For example, as illustrated in FIG. 7, separately-formed two heating elements 6 (i.e., a first heater and a second heater) may be provided only at positions facing adjacent rollers 3 (i.e., the first roller and the second roller). The heating elements 6 are provided at positions at which the heating unit 7 heats the belt 1 in the most effective manner. Since the area and the number of the heating elements 6 are reduced as compared with the structure in which the heating elements 6 are provided throughout the heating unit 7, power consumption of the apparatus is decreased.

Figure 8:
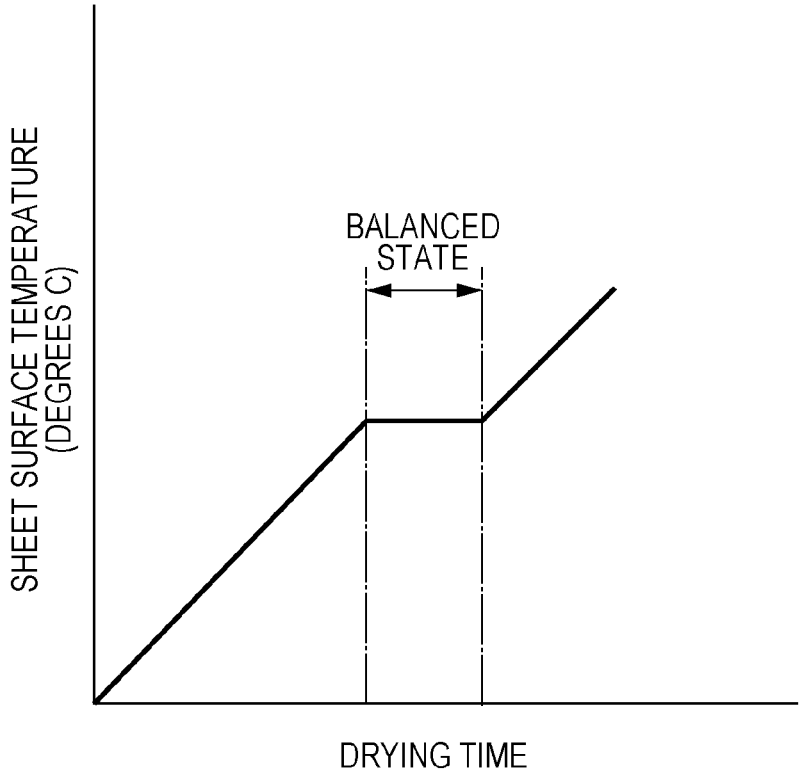
FIG. 8 is a graph illustrating a relationship between drying time and a sheet surface temperature.

A behavior of change in a surface temperature of the sheet S in the drying unit 51 will be discussed. It is found that the surface temperature of the sheet S is increased in a stepped manner, not in a constant manner. FIG. 8 is a graph illustrating a relationship between the drying time and the sheet surface temperature. The surface temperature of the sheet S starts increasing immediately after the sheet S is conveyed in the drying unit 51 and the moisture starts evaporating. The surface temperature stops increasing at a certain time instant and becomes constant. In this constant state, it is considered that the release of the latent heat and the energy of the heat are balanced. As the drying of the sheet S is continued, the balance between the release of the latent heat and the energy of the heat is lost at a certain time instant and the surface temperature of the sheet S starts increasing again. At this time instant, the sheet S is discharged from the drying unit 51.

Figure 9:
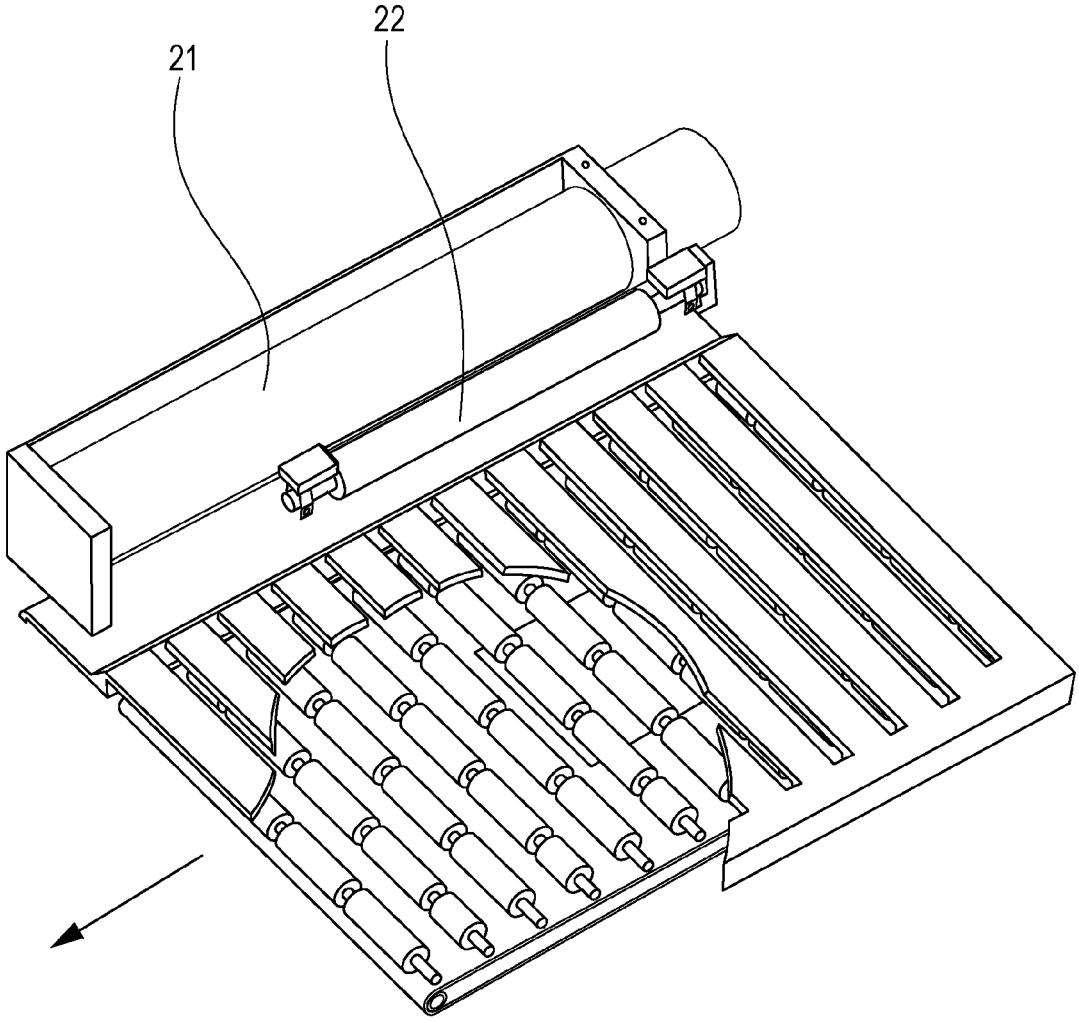
FIG. 9 is a perspective view of a structure of a drying apparatus in which a temperature is increased at an upstream side thereof.

With such a behavior of the change in the surface temperature of the sheet S, the sheet S is sufficiently dried by agitating the air layer above the sheet S and remove the produced vapor without heating the sheet S with the heating unit 7 after the balance is lost. Thus, as illustrated in FIG. 9, the sheet S may be heated with the heater 22 which is provided toward the upstream of the sheet travelling direction and the air may be blown on the sheet S in the downstream side without using the heater 22 in the chamber of the drying unit 51. In addition to this structure, a surface temperature distribution of the contact surface 5*a* of the heating unit 7 may be determined such that the upstream side might be higher than the downstream side. With this structure, the number and capacity of the heaters can be reduced, whereby power consumption of the apparatus is decreased.

According to the embodiment described above, the sheet S is dried with the hot air at the side of the outer surface of the belt 1 and, at the same time, is dried on the back surface thereof with the heat given from the inner surface 1*b* of the belt 1. In the drying process, the plurality of rollers 3 are pressed against the sheet S to enhance the contact between the outer surface 1*a* of the belt 1 and the sheet S, and between the inner surface 1*b* of the belt 1 and the contact surface 5*a* of the heating unit 7. With such close contact, the heat is transferred from the heating unit 7 to the sheet S via the belt 1 with high efficiency. In this manner, the sheet S can be dried reliably in high speed continuous printing and thus insufficient or uneven drying can be avoided.

Second Embodiment

Next, a second embodiment will be described. In high density printing, i.e., high-duty printing with a large amount of ink applied per unit area, it is possible that marks of divided small roller sections of rollers 3 as illustrated in FIG. 4 might appear on a surface of a sheet S. The reasons for this phenomenon are considered to be as follows: the sheet S having been subject to high density printing has a high moisture content and thus easily softens and deforms; and the sheet S is easily deformed due to stress concentration at boundaries of ends of the small roller sections and gaps Δd.

Figure 10:
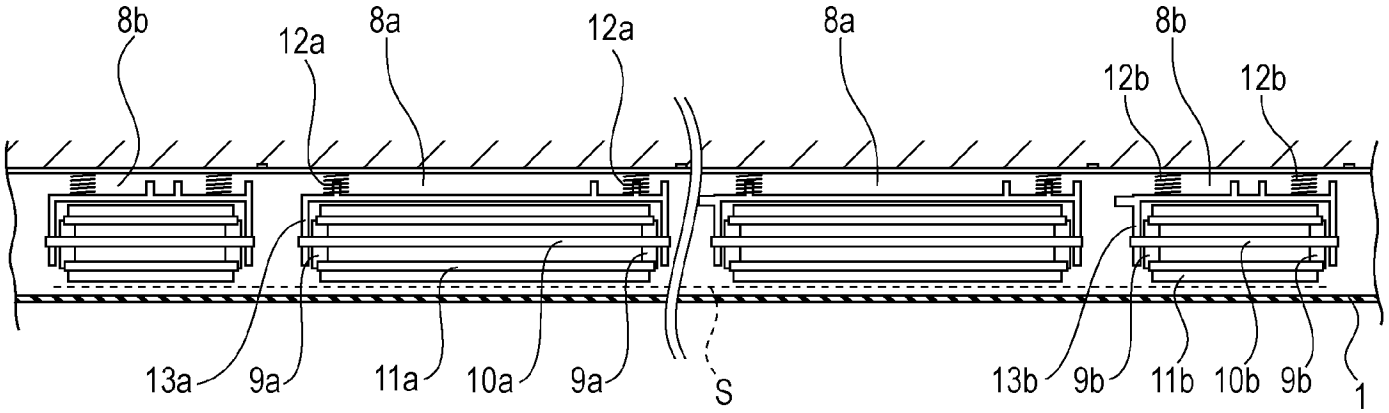
FIG. 10 is a sectional view of the vicinity of a roller in a drying apparatus according to a second embodiment.

In the second embodiment, urging force for each of the small roller sections is determined independently such that each of the small roller sections apply the urging force suitable for reliable high speed conveyance of the sheet S without any severe deformation on the sheet surface. FIG. 10 is a sectional view of a structure of a main part of an apparatus according to the second embodiment. Since the printing apparatus and the drying apparatus on the whole are the same as those of the first embodiment, description thereof will be omitted.

In the first embodiment, a plurality of small roller sections are arranged in series on a rotation axis in each of the rollers 3 and these small roller sections are held collectively. In the second embodiment, however, each of small roller sections arranged in series is supported independently by a separate support mechanism. Among the small roller sections arranged in series as illustrated in FIG. 10, the small roller sections 8*b* disposed at the outer sides of the rollers 3 are shorter than the small roller sections 8*a* disposed at the inner side of the rollers 3 along a rotational axis direction. Rollers with another arrangement of the small roller sections are also provided. Rollers of different arrangement are disposed alternately along the sheet travelling direction to form a staggered pattern similar to that of FIG. 4.

Each of the small roller sections 8 (8*a*, 8*b*) is constituted by bearings 9 (9*a*, 9*b*), shafts 10 (10*a*, 10*b*) and rollers 11 (11*a*, 11*b*). The shaft 10 is supported by two bearings 9 at both ends thereof and the bearings 9 are held by support members 13 (13*a*, 13*b*). The support members 13 (13*a*, 13*b*) are elastically supported on a plate member via separately-provided springs 12 (12*a*, 12*b*). Ejection ports 4 are formed on the plate member. The spring 12*a* and the spring 12*b* have different spring coefficients. Since the spring coefficients of the springs 12*a* and 12*b* are determined appropriately for the dimensions of the rollers 11*a* and 11*b*, the rollers 11*a* and 11*b* press the sheet S against a belt 1 uniformly with urging force. Since the urging force for each of the small roller sections is determined independently, any severe deformation of a surface of the sheet S or appearance of marks of the rollers on the sheet S can be avoided even in high density printing. In addition, the sheet S can be conveyed reliably at high speed. The rollers 11 may be formed of flexible rubber or foam or may have rounded corners. In this manner, appearance of the marks of the small roller sections in high density printing may further be reduced.

The rollers disposed alternately along the sheet travelling direction have spring coefficients different from one another. In particular, the rollers disposed in the upstream of the sheet travelling direction have smaller spring coefficients than the rollers disposed in the downstream. The reason for this is as follows.

As the sheet S after being subject to high density printing travels toward the downstream in the drying unit 51, an amount of curling in the sheet S increases. As a result, the curled sheet S may be caught in arbitrary roller 11 and may cause a conveyance jam. In order to avoid this phenomenon, the rollers are pressed against the belt 1, i.e., the sheet S, with relatively small urging force in the upstream side (which corresponds to a sheet introduction side) of the sheet travelling direction so as to protect the sheet S that has a high moisture content and is thus vulnerable to marks on the surface thereof. In the downstream side (which corresponds to a sheet discharge side) of the sheet travelling direction, the sheet S is pressed against the belt 1 by the rollers with the urging force larger than that of the rollers in the upstream side, whereby curling of the sheet S caused as the sheet S dries is reduced. As described above, since the rollers are provided with different urging force, i.e., the first roller in the upstream has smaller urging force than that of the second roller in the downstream, curling of the sheet S can be prevented while appearance of the marks of the small roller sections can be avoided.

Although all the small roller sections are supported independently in the above structure, some of the adjacent small roller sections may be supported by a common rotation axis along the direction of the rotation axis. Alternatively, a plurality of small roller sections may be supported integrally along the direction of the rotation axis and the first roller in the upstream has smaller urging force than that of the second roller in the downstream in the sheet travelling direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-002102 filed Jan. 7, 2010, which is hereby incorporated by reference herein in its entirety.

What is claimed is:

1. An apparatus for drying a sheet, comprising:

a rotatable belt which has an outer surface and an inner surface, a part of the outer surface being in contact with the sheet;

a plurality of rollers arranged in a direction in which the sheet travels, the rollers including a first roller and a second roller which are adjacent to each other, the rollers being pressed against the outer surface with the travelling sheet being held between the rollers and the outer surface;

a blowing mechanism which blows hot air on the sheet from between the first roller and the second roller; and a heating unit which includes a heating element and a contact surface which is disposed in contact with the inner surface, wherein the first roller is disposed in an upstream of the second roller in the direction and the first roller is pressed against the sheet with urging force smaller than that of the second roller.

2. The apparatus according to claim 1, wherein a slit-shaped ejection port is formed at a position corresponding to a space between the first roller and the second roller and the hot air is blown on the sheet through the ejection port.

3. The apparatus according to claim 1, wherein:

each of the first roller and the second roller is divided into a plurality of small roller sections along a direction of a rotation axis thereof;

gaps are formed between the small roller sections in the direction of the rotation axis; and a part of the hot air blown by the blowing mechanism is exhausted from spaces formed between the first roller and the second roller through the gaps.

4. The apparatus according to claim 3, wherein positions of the gaps formed in the first roller and positions of the gaps formed in the second roller are at least partially displaced from each other along the direction of the rotational axis.

5. The apparatus according to claim 4, wherein the small roller sections formed by dividing each of the plurality of rollers are disposed in a regular pattern.

6. The apparatus according to claim 1, wherein the first roller and the second roller are divided into a plurality of small roller sections, each of which is supported independently.

7. The apparatus according to claim 1, wherein the contact surface includes a first contact surface which faces the first roller and a second contact surface which faces the second roller.

8. The apparatus according to claim 1, wherein the heating element includes a first heater which faces the first roller and a second heater which faces the second roller.

9. The apparatus according to claim 1, wherein the contact surface has an area in which temperature is higher in an upstream side than a downstream side in the direction in which the sheet travels.

10. The apparatus according to claim 1, wherein a coefficient of friction between the outer surface and the sheet is greater than a coefficient of friction between the inner surface and the contact surface.

11. The apparatus according to claim 1, wherein the contact surface is made of aluminum, copper, stainless steel or a carbon graphite resin material.

12. The apparatus according to claim 1, wherein the blowing mechanism includes a heater and a fan which cause the hot air to circulate in a housing of the apparatus.

13. A printing apparatus comprising: a printing unit which applies ink to a sheet in an inkjet printing process; and the drying apparatus according to claim 1 which dries the sheet on which the ink is applied in the printing unit.

14. An apparatus for drying a sheet, comprising:

a conveying unit having a plurality of rollers arranged in a direction in which the sheet travels, the rollers including a first roller and a second roller; and a heating unit configured to heat the sheet at a position between the first roller and the second roller, wherein the first roller is disposed in an upstream of the second roller in the direction and the first roller is pressed against the sheet with urging force smaller than that of the second roller.

15. The apparatus according to claim 14, wherein the heating unit includes a slit-shaped ejection port at the position and hot air is blown on the sheet through the ejection port.

16. The apparatus according to claim 15, wherein:

each of the first roller and the second roller is divided into a plurality of small roller sections along a direction of a rotation axis thereof;

gaps are formed between the small roller sections in the direction of the rotation axis; and a part of the hot air blown from the ejection port is exhausted from spaces formed between the first roller and the second roller through the gaps.

17. The apparatus according to claim 16, wherein positions of the gaps formed in the first roller and positions of the gaps formed in the second roller are at least partially displaced from each other along the direction of the rotational axis.

18. The apparatus according to claim 14, wherein the first roller and the second roller are divided into a plurality of small roller sections, each of which being supported independently.

19. An apparatus comprising:

a processing unit which applies liquid to the sheet; and the drying apparatus according to claim 14 which dries the sheet processed by the processing unit.

* * * * *